US008862007B2

(12) United States Patent
Gon

(10) Patent No.: US 8,862,007 B2
(45) Date of Patent: Oct. 14, 2014

(54) IMAGE FORMING APPARATUS EQUIPPED WITH A FIXING DEVICE CONFIGURED TO INDUCE ELECTROMAGNETIC HEATING

(71) Applicant: KYOCERA Document Solutions Inc., Osaka (JP)

(72) Inventor: Shoko Gon, Osaka (JP)

(73) Assignee: KYOCERA Document Solutions Inc. (JP)

( * ) Notice: Subject to any disclaimer, the term of this patent is extended or adjusted under 35 U.S.C. 154(b) by 92 days.

(21) Appl. No.: 13/853,280

(22) Filed: Mar. 29, 2013

(65) Prior Publication Data

US 2013/0259509 A1 Oct. 3, 2013

(30) Foreign Application Priority Data

Mar. 30, 2012 (JP) ..... 2012-079131

(51) Int. Cl.
*G03G 15/00* (2006.01)
*G03G 15/20* (2006.01)

(52) U.S. Cl.
CPC ..... *G03G 15/2078* (2013.01); *G03G 15/2053* (2013.01)
USPC ..... 399/68; 399/328; 399/67; 399/69; 399/45

(58) Field of Classification Search
USPC ..... 399/45, 68, 69, 67, 334, 328
See application file for complete search history.

(56) References Cited

U.S. PATENT DOCUMENTS

| | | | | |
|---|---|---|---|---|
| 8,750,733 | B2 * | 6/2014 | Urano | 399/45 |
| 2006/0213902 | A1 * | 9/2006 | Nanjo | 219/619 |

FOREIGN PATENT DOCUMENTS

| | | | |
|---|---|---|---|
| JP | 63-218984 | A | 9/1988 |
| JP | 10-104974 | | 4/1998 |
| JP | 2000-162912 | | 6/2000 |
| JP | 2001-318545 | | 11/2001 |
| JP | 2008-281879 | A | 11/2008 |
| JP | 2009-198665 | | 9/2009 |
| JP | 2009-204789 | A | 9/2009 |

* cited by examiner

*Primary Examiner* — Walter L Lindsay, Jr.
*Assistant Examiner* — Roy Y Yi
(74) *Attorney, Agent, or Firm* — McDonnell Boehnen Hulbert & Berghoff LLP

(57) ABSTRACT

A fixing device includes a heating member, a pressurizing member, a coil wound in a loop shape in the width direction of the heating member to generate a magnetic flux that inductively heats the heating member, and a magnetic core adjacent to the coil. The magnetic core is configured to apply the magnetic flux to an inductive heat-generating layer of the heating member. The magnetic core includes first core parts and second core parts. The first core parts are positioned to enclose the coil in a direction orthogonal to a direction in which paper is conveyed. The second core parts are placed in hollow areas formed by the loops of the coil at both ends in the direction orthogonal to the paper conveyance direction. The second core parts have a higher Curie temperature and a lower thermal capacity than the first core parts.

20 Claims, 8 Drawing Sheets

IMAGE FORMING APPARATUS EQUIPPED WITH A FIXING DEVICE CONFIGURED TO INDUCE ELECTROMAGNETIC HEATING

REFERENCE TO RELATED APPLICATIONS

This application is based upon and claims the benefit of priority from corresponding Japanese Patent Application No. 2012-079131 filed in the Japan Patent Office on Mar. 30, 2012, the entire contents of which are incorporated herein by reference.

BACKGROUND

Devices may be configured to induce electromagnetic heating and an eddy current may be generated on an inductive heat-generating layer of a heating member. Eddy currents may be generated by, for example, a magnetic flux generated by an excited coil. When Joule heat generated by the eddy current causes the heating member to generate heat, the heating member is heated to a prescribed fixing temperature. With this type of device, the thermal capacity of the heating member can be reduced to shorten the warm-up time associated with the device. In addition, the device may be equipped with a compact structure to obtain a high heat-exchanging efficiency.

With a fixing device configured to induce electromagnetic heating, heat is often lost from the surface of its heating member when the surface makes contact with paper. In particular, the heating member may have a paper feeding area and a non-paper feeding area (or a "non-feeding area"). Thus, a paper feeding area where paper passes is likely to be at a lower temperature than non-feeding areas where paper does not pass. Paper sheets with smaller sizes may be in a fixed position, particularly when the paper sheets are fixed sequentially or in succession. If the area corresponding to the paper feeding area is maintained at fixing process temperature, the temperature of the non-feeding area may become excessively high. This may cause the temperatures of the heating member and excited coil to exceed their maximum allowable temperatures, and they may be damaged as a result.

A proposed fixing device has a magnetic core with a Curie temperature set to a temperature that is slightly higher than fixing process temperature. The fixing device also has a coil that uses the magnetic core to generate a magnetic flux by which the heating member is inductively heated. The magnetic core has different Curie temperatures in a direction orthogonal to a paper-conveying direction. Specifically, the magnetic core in the fixing device is configured so that the Curie temperature at both ends of the magnetic core is lower than the Curie temperature at the central portion of the magnetic core. When small sheets of paper are fixed in succession, this structure can prevent a large deviation in temperature between the paper feeding area and the non-feeding areas. With this type of fixing device, the Curie temperature at both ends of the magnetic core (also referred to "end-sides of the magnetic core") is equivalent to that of the non-feeding areas when small sheets of paper are fed. Thus, the Curie temperature at the end-sides of the magnetic core are set to a temperature lower than the Curie temperature of the central portion of magnetic core that includes the paper feeding area for small-sized paper. In some instances, the temperature of the heating member corresponding to the non-feeding area may become excessively high during the fixing of small-sized paper. In such instances, both ends of the magnetic core or the end-sides of the magnetic core may have been heated to or above their Curie temperature due to thermal radiation or thermal conduction from the heating member. In response, the magnetic permeability of the end-sides of the magnetic core may be lowered. As such, lowering the magnetic permeability reduces the amount of heat generated in the area corresponding to the non-feeding areas on the heating member. Therefore, the temperature on the heating member corresponding to the non-feeding areas can be lowered to prevent damage to the fixing device.

A magnetic core in another fixing device has a plurality of first magnetic cores. The magnetic core may be formed in a trapezoidal shape and placed in a direction orthogonal to a paper conveying direction so as to cover a coil that generates a magnetic flux. The magnetic flux may be used for inductive heating and may also have a plurality of second magnetic cores that are placed in clearances or hollow areas formed by rings of a coil. The rings of coil may be wound in a loop shape in a direction orthogonal to the paper conveying direction. The Curie temperature of each end-side of the magnetic core may correspond to one non-feeding area. Further, the Curie temperature of the second magnetic core may be set to a temperature lower than the Curie temperature of the first magnetic core. Each end-side of the magnetic core may be positioned separately from the first magnetic core and may have a lower thermal capacity than the first magnetic core. With this structure, the temperature on areas of the heating member corresponding to the non-feeding area may be controlled and prevented from becoming excessively high. In particular, the temperatures of the end-sides of the magnetic core (e.g., the non-feeding areas) may be controlled to reach their Curie temperature relatively quickly due to the thermal radiation or thermal conduction from the heating member to the end-sides of the magnetic core. Therefore, this prevents the area on the heating member corresponding to the non-feeding area from becoming excessively high.

With the fixing device described above, however, the end-sides of the magnetic core may not adequately track changes in the temperature of the heating member.

If the end-sides of the magnetic core cannot adequately track changes in the temperature of the heating member, a fixing failure may occur because heating in the non-feeding areas may become insufficient. This may happen when small sheets of paper are fed in succession and the temperature of the end-sides of the magnetic core corresponding to the non-feeding areas exceed their Curie temperature. As such, if paper with a larger fixed size is fed, uniform heating and fixing cannot be performed over the entire surface of the paper with the fixed size.

SUMMARY

In view of the above situation, a proposed fixing device is structured, for example, so that the temperature of the magnetic core is determined by measuring an overcurrent flowing in a coil. When an overcurrent flow is detected in the coil, that is, the temperature of the magnetic core has exceeded its Curie temperature, the time elapsed after the Curie temperature has been met or exceeded is measured. If the elapsed time is longer than or equal to a prescribed time, a nip part is judged to have been adequately heated. As such, a fixing process is performed on paper sheets with a fixed size. If the elapsed time is shorter than the prescribed time after a fixing process is performed on sheets of paper with the fixed size and with a prescribed spacing between the sheets of paper, the nip part is judged not to have been adequately heated.

A fixing device in an aspect of the present disclosure includes a heating member, a pressurizing member that makes pressured contact with the heating member, a coil wound in a loop shape in the width direction of the heating member, where the coil is configured to generate a magnetic flux that inductively heats the heating member, and a magnetic core adjacent to the coil. The magnetic core is configured to apply the magnetic flux to an inductive heat-generating layer of the heating member. The magnetic core includes a plurality of first core parts and a plurality of second core parts. The plurality of first core parts are positioned to enclose the coil in a direction orthogonal to a paper conveyance direction in which a recording medium is conveyed. The plurality of second core parts are placed in hollow areas formed by the loops of the coil at both ends in a direction orthogonal to the paper conveyance direction. The plurality of second core parts have a lower Curie temperature and a lower thermal capacity than the plurality of first core parts. After a first fixing process is performed on a first recording medium and a surface temperature in non-feeding areas is raised above an upper fixing-ready temperature limit (e.g., a maximum temperature for a fixing process), a second fixing process is performed on a second recording medium having a larger width than the first recording medium, where the first recording medium has a smaller width than a maximum width for the first fixing process and the second fixing process. After the surface temperature in non-feeding areas drops to or below the upper fixing-ready temperature limit, the second recording medium is inserted into a nip part formed by the heating member and the pressurizing member.

An image forming apparatus in another aspect of the present disclosure has an image forming unit and the fixing device described above.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
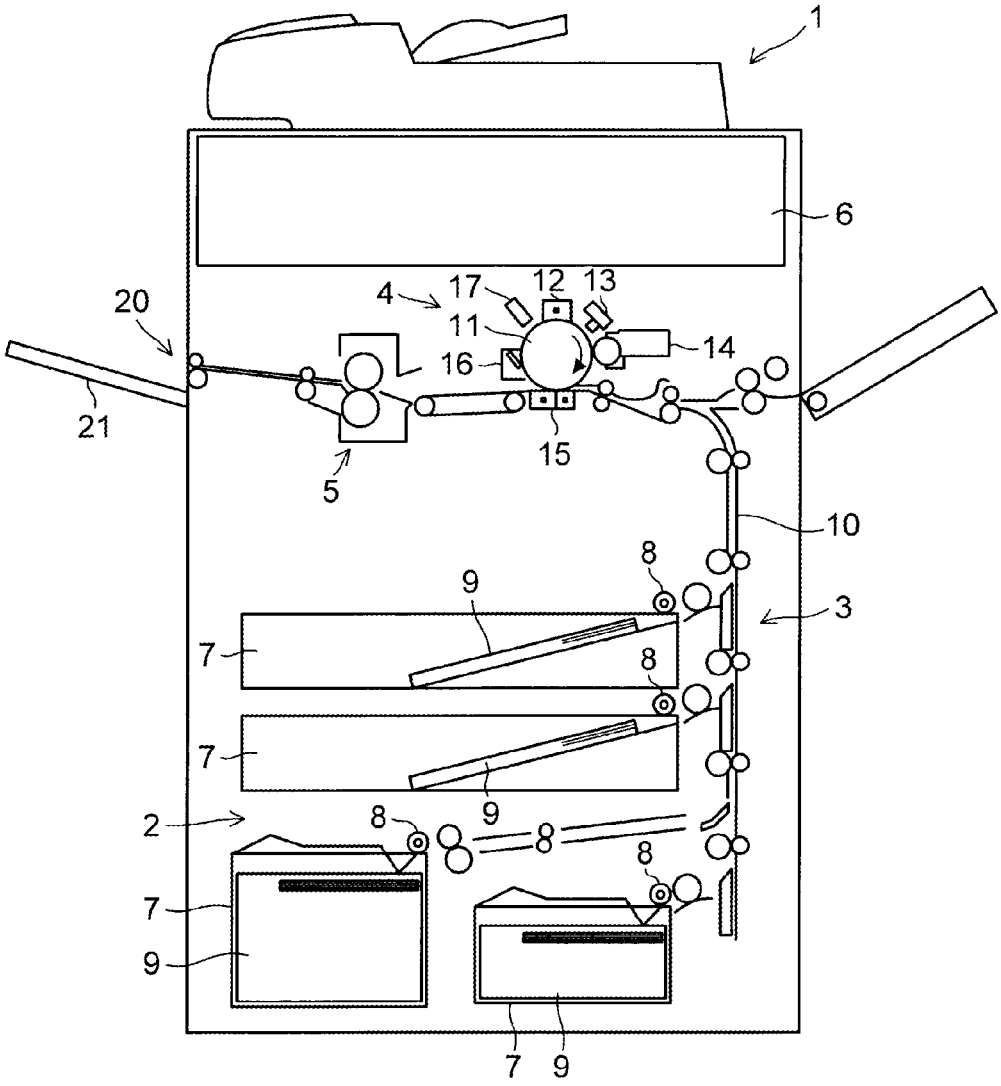
FIG. 1 schematically illustrates the structure of an image forming apparatus having a fixing device in an embodiment of the present disclosure.

An example apparatus and unit are described herein. Other example embodiments or features may further be utilized, and other changes may be made, without departing from the spirit or scope of the subject matter presented herein. In the following detailed description, references are made to the accompanying drawings.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Some embodiments of the present disclosure may be described with reference to the drawings. However, the present disclosure is not limited to these embodiments. There are no limitations to applications of the embodiment of the present disclosure and terms used in the embodiment are not meant to be limiting.

FIG. 1 schematically illustrates the structure of an image forming apparatus having a fixing device in an embodiment of the present disclosure. The image forming apparatus 1 has a paper feeding unit 2, a paper conveying unit 3 placed next to the paper feeding unit 2, an image forming unit 4 placed above the paper conveying unit 3, a fixing device 5 placed to the left of the image forming unit 4, and an image reading unit 6 placed above the image forming unit 4 and fixing device 5.

The paper feeding unit 2 has a plurality of paper feeding cassettes 7 that store paper sheets 9, which are examples of recording media. The paper feeding unit 2 feeds one paper sheet 9 at a time from one paper feed cassette 7 selected from the plurality of feed cassettes 7. The paper is fed to the paper conveying unit 3 by using the rotation of a feed roller 8.

The paper 9 fed to the paper conveying unit 3 is conveyed through a paper conveying path 10 toward the image forming unit 4. The image forming unit 4 executes an electrophotographic process to form a toner image on the paper 9. The image forming unit 4 has a photosensitive body 11 that is supported so as to be rotatable in a direction indicated by the arrow in FIG. 1. A charging unit 12 is placed around the photosensitive body 11 in the rotational direction of the photosensitive body 11 along with an exposing unit 13, a developing unit 14, a transcribing unit 15, a cleaning unit 16, and a static eliminating unit 17.

The charging unit 12 has a charging wire to which a high voltage is applied. The charging unit 12 uniformly charges the surface of the photosensitive body 11 by having the charging wire cause a corona discharge to apply a prescribed electrical potential to the surface of the photosensitive body 11. When light based on image data of, for example, a manuscript read out by the image reading unit 6 is directed to the photosensitive body 11 by the exposing unit 13, the electric potential on the surface of the photosensitive body 11 is selectively attenuated, forming an electrostatic latent image on the surface of the photosensitive body 11.

Then, the developing unit 14 develops the electrostatic latent image on the surface of the photosensitive body 11, forming a toner image on the surface of the photosensitive body 11. The toner image is transcribed by the transcribing unit 15 to the paper 9 supplied between the photosensitive body 11 and the transcribing unit 15.

The paper 9, on which the toner image has been transcribed, is conveyed toward the fixing device 5 positioned downstream from the image forming unit 4 in the paper conveyance direction. In the fixing device 5, the paper 9 is heated and pressurized, melting and fixing the toner image on the paper 9. The paper 9, on which the toner image has been fixed, is ejected onto an ejection tray 21 by an ejection roller pair 20.

After the toner image has been transcribed onto the paper 9 by the transcribing unit 15, toner remaining on the surface of the photosensitive body 11 is removed by the cleaning unit 16. Charges remaining on the surface of the photosensitive body 11 are removed by the static eliminating unit 17. The photosensitive body 11 is charged again by the charging unit 12 and an image is then formed similarly as described above.

Figure 2:
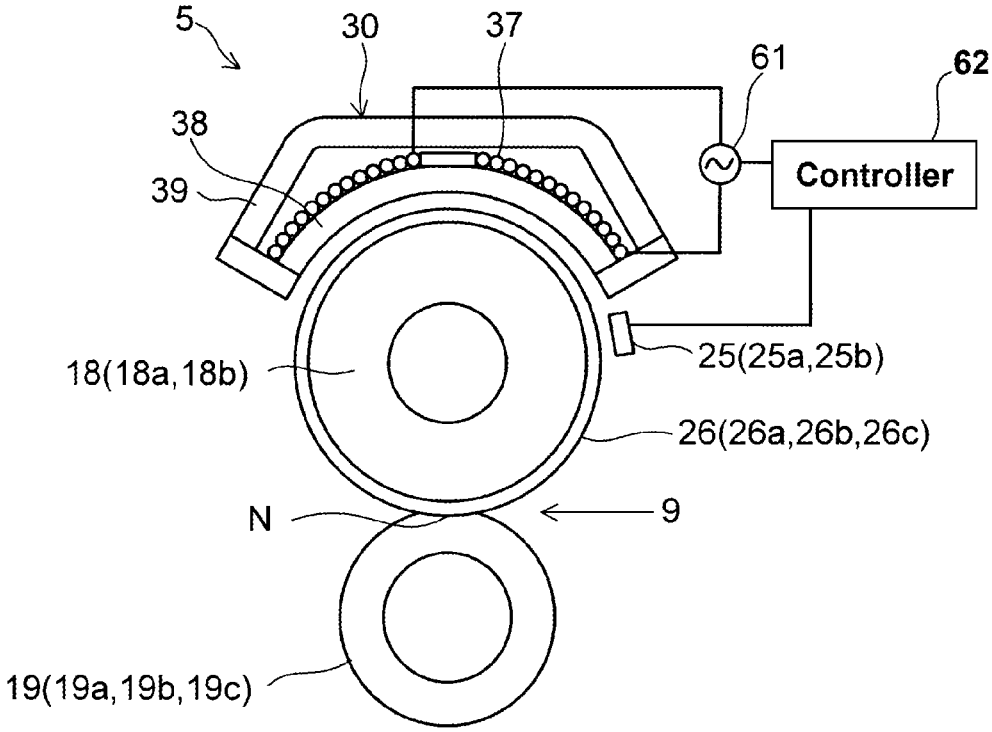
FIG. 2 is an elevated, cross-sectional side view of the fixing device having an inductive heating unit in this embodiment.

The fixing device 5 in the embodiment of the present disclosure will be described with reference to FIG. 2. FIG. 2 is an elevated, cross-sectional side view that schematically illustrates the fixing device 5.

The fixing device 5 uses a fixing method in which electromagnetic induction heating is carried out. The fixing device 5 has a heat-generating belt 26, which is a heating member, and a pressurizing roller 19, which is a pressurizing member. Further, the fixing device 5 has a fixing roller 18 to which the heat-generating belt 26 is integrally attached, an inductive heating unit 30 that supplies a magnetic flux to the heat-generating belt 26, and a temperature sensing unit 25. Yet further, fixing device 5 has a controller 62 connected to the temperature sensing unit 25 and inductive heating unit 30, and a power supply 61 that supplies a high-frequency current to a coil of the inductive heating unit 30. The pressurizing roller 19 and fixing roller 18 are supported to a housing (not shown) of the fixing device 5. The pressurizing roller 19 is supported to the housing so as to be rotatable in the counterclockwise direction and the fixing roller 18 is supported to the housing so as to be rotatable in the clockwise direction, when they are looked in a section, as shown in FIG. 2. The inductive heating unit 30 and temperature sensing unit 25 are secured to the housing.

The heat-generating belt 26 is an perpetual heat-resistant belt. The heat-generating belt 26 is formed by sequentially laminating an inductive heat-generating layer 26*a*, with a thickness of at least 30 μm and at most 50 μm, that is formed by, for example, nickel electroforming. Further, the heat-generating belt 26 is also formed with an elastic layer 26*b*, with a thickness of at least 200 μm and at most 500 μm, that is formed with, for example, silicone rubber. Yet further, the heat-generating belt 26 is also formed with a mold releasing layer 26*c*, formed with, for example, a fluorocarbon resin, that improves releasing the mold when a non-fused toner image is melted and fixed in a nip part N from the inner circumferential side.

The fixing roller 18 stretches the inner circumferential surface of the heat-generating belt 26. This enables the heat-generating belt 26 to be rotated together with the fixing roller 18. The outer diameter of the fixing roller 18 is, for example, 39.8 mm. The fixing roller 18 has, for example, a core metal 18*a* made of a stainless steel and an elastic layer 18*b*, formed with silicone rubber that is placed on the fixing roller 18*a* so that the thickness of the fixing roller 18 becomes at least 5 mm and at most 10 mm. The fixing roller 18*b* stretches the heat-generating belt 26.

The pressurizing roller 19 has a core metal 19*a*, which is cylindrical, an elastic layer 19*b* formed on the core metal 19*a*, and mold releasing layer 19*c* that covers the surface of the elastic layer 19*b*. The outer diameter of the pressurizing roller 19 is, for example, 35 mm. The core metal 19*a* of the pressurizing roller 19 is made of a stainless steel and the elastic layer 19*b* is formed on the pressurizing roller 19*a*. The elastic layer 19*b* has a thickness of at least 2 mm and at most 5 mm, and is made of a silicone rubber. A mold releasing layer 19*c*, formed with, for example, a fluorocarbon resin may be placed on the pressurizing roller 19*b*. The rotation of the pressurizing roller 19 is driven by a motor (not shown) or another driving source. When the pressurizing roller 19 is rotated, the heat-generating belt 26 is also rotated accordingly. The nip part N is formed in an area where the pressurizing roller 19 is brought into pressured contact with the heat-generating belt 26. In the nip part N, the toner image is fixed on the paper 9. In particular, the paper 9 is fed from the image forming unit 4, is heated and pressurized, and the toner image is fixed on the paper 9.

The inductive heating unit 30 has a coil 37, a bobbin 38, and a magnetic core 39. The inductive heating unit 30 causes the heat-generating belt 26 to generate heat through electromagnetic induction. The inductive heating unit 30, which extends in the longitudinal direction (perpendicular to the drawing sheet of FIG. 2), is positioned so as to face the heat-generating belt 26 and substantially covers half of the outer circumference of the heat-generating belt 26.

The coil 37 is attached to the bobbin 38 by, for example, being wound around bobbin 38 with a plurality of turns in a loop shape in the width direction of the heat-generating belt 26 (perpendicular to the drawing sheet of FIG. 2). The coil 37 is connected to the power supply 61 to generate an AC magnetic flux from the high-frequency current supplied from the power supply 61. The magnetic flux, generated by the coil 37, passes through the magnetic core 39 and is led in a direction parallel to the drawing sheet of FIG. 2. Further, the magnetic flux passes through the heat-generating belt 26 so as to pass along the inductive heat-generating layer 26*a* of the heat-generating belt 26. An eddy current is generated in the inductive heat-generating layer 26*a* due to a change in the intensity of the AC current of the magnetic flux passing through the inductive heat-generating layer 26*a*. When the eddy current flows in the inductive heat-generating layer 26*a*, Joule heat is generated due to an electric resistance of the inductive heat-generating layer 26*a*, causing the heat-generating belt 26 to generate heat (the heat-generating belt 26 performs self-heating).

The temperature sensing unit 25 has a non-contact temperature sensing element 25*a*, which is a first temperature sensor, and thermistors 25*b*, which are second temperature sensors. Specifically, the temperature sensing unit 25 is structured so that it senses a temperature on the surface of the heat-generating belt 26. The non-contact temperature sensing element 25*a* is disposed substantially at the center in the width direction of the heat-generating belt 26. The non-contact temperature sensing element 25*a* senses a temperature on the surface of an area, corresponding to a paper-feeding area B, on the heat-generating belt 26 (see FIG. 5). The thermistors 25*b* are disposed at portions near one end in the axial direction of the heat-generating belt 26. Each thermistor 25*b* senses a temperature on the surface of an area, corresponding to one non-feeding area C on the heat-generating belt 26 (see FIG. 5).

The controller 62 has a microcomputer, storage elements including a random-access memory (RAM) and a read-only memory (ROM), and the like. The controller 62 controls the high-frequency current supplied from the power supply 61 to the coil 37 according to the temperatures on the surface of the heat-generating belt 26. The temperature may be sensed by the non-contact temperature sensing element 25*a* and thermistors 25*b*. This control may cause the paper 9 fed to the nip part N to be appropriately fixed. The controller 62 also controls a spacing between each two paper sheets 9 that are fed to the nip part N in succession according to the temperatures sensed by the non-contact temperature sensing element 25*a* and thermistors 25*b*.

When the heat-generating belt 26 is heated to a temperature at which fixing is possible, the paper 9 held in the nip part N is heated and is pressurized by the pressurizing roller 19, so toner transcribed to the paper 9 (originally in a powder state) is melted and fixed to the paper 9. In this embodiment, the heat-generating belt 26 is made of a thin material with high thermal conductivity, so its thermal capacity is low. Accordingly, the fixing device 5 can be warmed up in a short period of time, enabling image forming to be started quickly.

Figure 3:
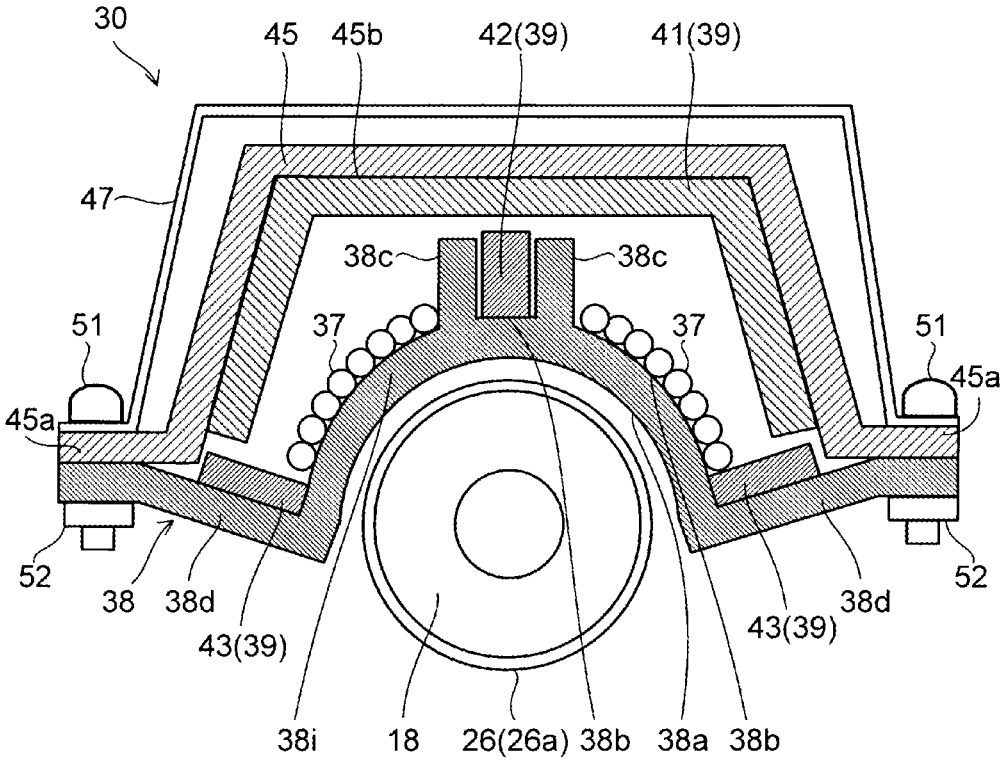
FIG. 3 is an elevated, cross-sectional side view of the inductive heating unit in this embodiment.

The structure of the inductive heating unit 30 will be described in further detail with reference to FIG. 3. FIG. 3 is an elevated cross-sectional view of the inductive heating unit 30.

As described above, the inductive heating unit 30 has the coil 37, the bobbin 38, which is a supporting member, and the magnetic core 39. The magnetic core 39 has an arch core 41, which is a first core part, both ends of center core 42 or "end-sides of center core 42", which are second core part, and side cores 43. The inductive heating unit 30 further has an arch core holder 45 structured so that the arch core 41 is attached to the arch core holder 45, and a cover 47 that covers the magnetic core 39 and coil 37.

The bobbin 38 is disposed concentrically with the rotational central axis of the fixing roller 18 with a prescribed spacing between the bobbin 38 and the surface of the heat-generating belt 26. The bobbin 38 has an arc part 38*i* that covers substantially one half of the circumferential surface of the heat-generating belt 26 on its cross section in a direction orthogonal to the rotational central axis. The arc part 38*i* is arc-shaped on the cross section. The bobbin 38 also has flanges 38*d* that extend from both ends of the arc part 38*i*. The arc part 38*i* and flanges 38*d* form a main skeletal part of the bobbin 38. Preferably, they are at least 1 mm and at most 2 mm in thickness. For example, they may be 1.5 mm in thickness so that the strength of the skeletal part can be maintained. To withstand heat released from the heat-generating belt 26, the bobbin 38 is made of one or more of the following: a liquid crystal polymer (LCP) resin, a polyethylene terephthalate (PET) resin, a poly phenylene sulfide (PPS) resin, or another heat-resistant resin.

The arc part 38*i* of the bobbin 38 has an opposite surface 38*a* that faces the surface of the heat-generating belt 26 with a prescribed spacing in between the opposite surface 38*a* and heat-generating belt 26. The arc part 38*i* also has an attachment surface 38*b* located on the other side of the opposite surface 38*a*. A pair of end-sides of center core 42 are attached with an adhesive substantially at the center of the attachment surface 38*b*, that is, on a line that interconnects the rotational central axes of the fixing roller 18 and pressurizing roller 19 (see FIG. 2). A standing wall 38*c* erected from the attachment surface 38*b* extends around the end-sides of center core 42 in the longitudinal direction (perpendicular to the drawing sheet of FIG. 3). The coil 37 is attached to the attachment surface 38*b*. The spacing between the surface of the heat-generating belt 26 and the opposite surface 38*a* of the bobbin 38 is, for example, at least 1.5 mm and at most 3 mm to prevent a contact with the opposite surface 38*a* when the heat-generating belt 26 is rotated. The end-sides of center core 42 are disposed at a distance of, for example, 4 mm from the surface of the heat-generating belt 26.

A coil formed by twisting a plurality of enamel wires coated with a fusing layer is used as the coil 37. For example, an AlW wire with a heat-resistant temperature of about 200° C. is used. To form the coil 37 in a prescribed shape (loop shape), its fusing layer is melted by, for example, heating the wires in a state in which the wires are wound in a loop shape around the attachment surface 38*b*. The wires may be heated in an arch shape in the longitudinal direction (orthogonal to the drawing sheet of FIG. 3), and the coil 37 is then cooled. The coil 37 solidified in the prescribed shape is placed around the standing wall 38*c* of the bobbin 38 and is attached to the attachment surface 38*b* with a silicone adhesive or the like.

A plurality of side cores 43 are attached to a surface of each flange 38*d* with an adhesive in the longitudinal direction, the surface being the same side as the arc part 38*i*. The arch core holder 45 is attached on the same side as the outer edges of the flanges 38*d*.

The arch core holder 45 has holder flanges 45*a* attached to the flanges 38*d* of the bobbin 38 and also has a plurality of core attaching parts 45*b*, each of which extends in an arch shape from each arch core holder 45*a* in the longitudinal direction. One arch core 41 having substantially the same shape as the core attaching parts 45*b* is attached to each core attaching part 45*b* with an adhesive.

As described above, the end-sides of center core 42, side cores 43, and arch cores 41 are attached at prescribed positions on the bobbin 38 and arch core holder 45. Accordingly, the arch cores 41 and side cores 43 enclose the outside of the coil 37. The end-sides of center core 42 are disposed closer to the surface of the heat-generating belt 26 than the arch core 41. The coil 37 is enclosed by the surface of the heat-generating belt 26, the side cores 43, the arch cores 41, and the end-sides of center core 42. When a high-frequency current is supplied to the coil 37, the magnetic flux generated from the coil 37 is applied and/or led to the side core 43, arch cores 41, and end-sides of center core 42, after which the magnetic flux flows along the heat-generating belt 26. At that time, since an eddy current flows in the inductive heat-generating layer 26*a* of the heat-generating belt 26, Joule heat is generated in the inductive heat-generating layer 26*a* due to the electric resistance of the inductive heat-generating layer 26*a*, causing the heat-generating belt 26 to generate heat.

The cover 47 is structured so as to shield the magnetic flux generated from the inductive heating unit 30. For example, the cover 47 is structured so that an aluminum plate encloses the periphery of the coil 37 and magnetic core 39 from a side opposite to the bobbin 38. The cover 47 is attached by, for example, stacking the arch core holder 45*a* of the arch core holder 45 and the flange of the cover 47 on the flange 38*d* of the bobbin 38 and by tightening screws 51 and nuts 52.

Figure 4:
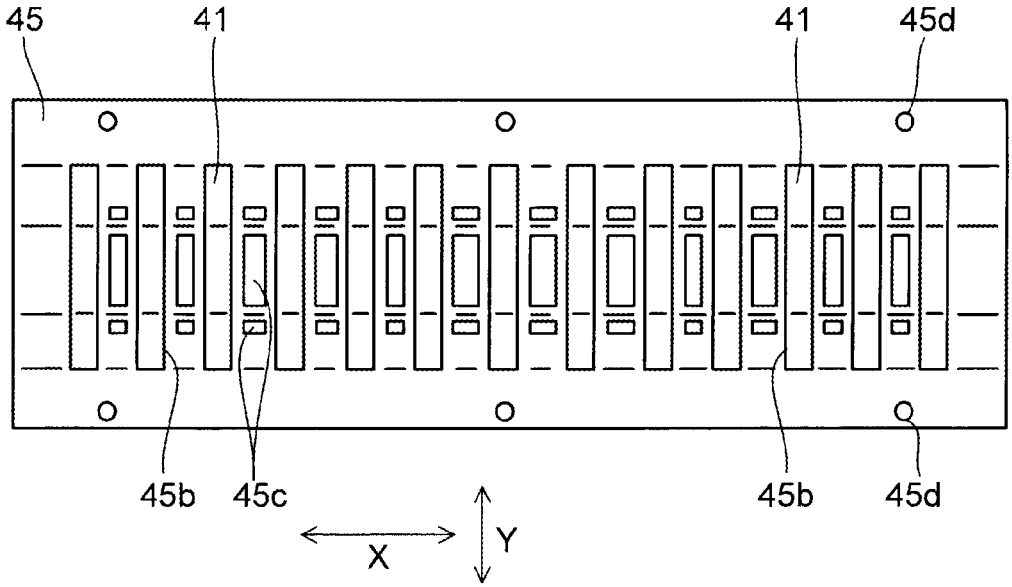
FIG. 4 is a plan view illustrating the placement of arch cores in the inductive heating unit in this embodiment.
Figure 5:
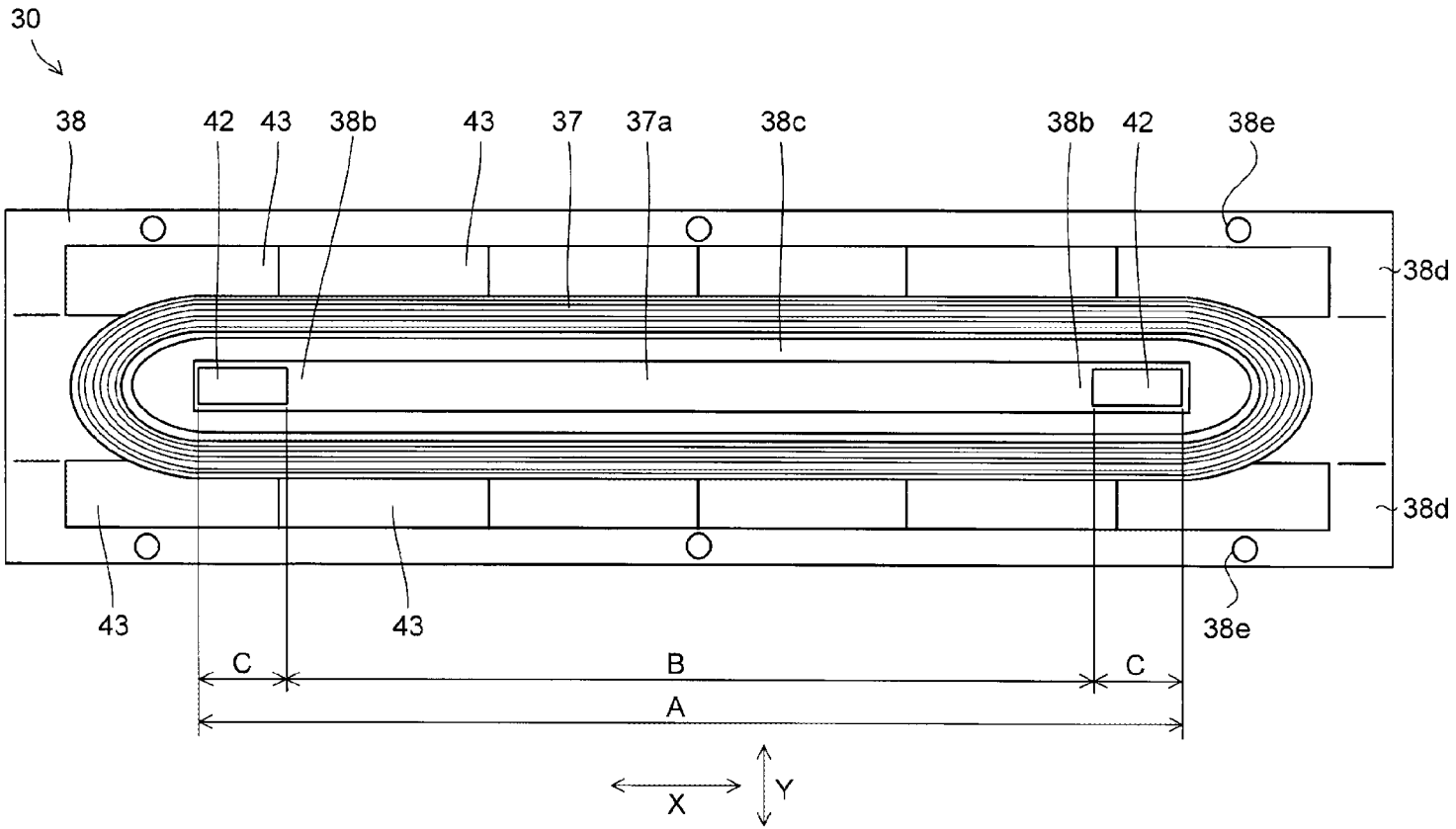
FIG. 5 is a plan view illustrating the placement of end-sides of the center core in the inductive heating unit in this embodiment.

FIGS. 4 and 5 illustrate the placement of the magnetic core 39 and bobbin 38. FIG. 4 is a plan view illustrating the placement of the arch core 41 with respect to the arch core holder 45 when viewed from the bottom in FIG. 3 (from the bobbin 38). FIG. 5 is a plan view illustrating the placement of the coil 37, end-sides of center core 42, and side core 43 with respect to the bobbin 38 when viewed from the top in FIG. 3 (from the arch core holder 45).

As illustrated in FIG. 4, a plurality of core attaching parts 45*b*, each of which attaches the relevant arch core 41 to a prescribed position, are spaced in the arch core holder 45 at substantially equal intervals in an X direction (orthogonal to the paper conveyance direction in the drawing sheet). A holder opening 45*c* is formed between each two adjacent core attaching parts 45*b*. A plurality of screw holes 45*d* are formed in correspondence to the screws 51 (see FIG. 3), which attach the arch core holder 45 to the bobbin 38 (see FIG. 3) covering the core attaching parts 45*b*.

The arch core 41 is formed in an arch shape, the cross-sectional view of which is rectangular, composed of, for example, a ferrite with high magnetic permeability such as a ferrite based on an Mn—Zn alloy. The Curie temperature of the arch core 41 is set to a temperature greater than or equal to the temperature of the arch core 41 obtained when the nip part N reaches a temperature at which fixing is possible. When the temperature of the arch core 41 exceeds its Curie temperature, the magnetic permeability of the arch core 41 is rapidly lowered, resulting in the inability of the arch core 41 to function as a magnetic body. The Curie temperature of the arch core 41 is set to a prescribed temperature by, for example, adjusting the ratio of materials (Mn to Zn or Zn to Mn of an Mn—Zn alloy, for example). The arch core 41 has, for example, a width (in the X direction) of 10 mm and a thickness of 4.5 mm. The arch core 41 is fitted within the length of the coil 37 (see FIG. 5) in the X direction. For example, 13 arch cores 41 are equally spaced in a segment 310 mm in length. The thermal capacity of the arch core 41 is calculated to be 15 J/K from its specific gravity and specific heat. Since the arch core 41 is formed in, for example, an arch shape, its thermal capacity becomes comparatively higher. The arch core 41 is placed at a comparatively long distance from the heat-generating belt 26. Therefore, the ability of the arch core 41 to track changes in the temperature of the heat-generating belt 26 is inferior compared with the end-sides of center core 42.

As illustrated in FIG. 5, the bobbin 38 has the standing wall 38*c* erected from the attachment surface 38*b*, the flanges 38*d*, and a plurality of screw holes 38*e* formed in correspondence to the screws 51 (see FIG. 3). A plurality of side cores 43 are attached to each flange 38*d*.

The side core 43 is formed in a rectangular, parallelepiped shape and composed of a ferrite with high magnetic permeability such as a ferrite based on an Mn—Zn alloy. The Curie temperature of the side core 43 is set to a temperature greater than or equal to the temperature of the side core 43 obtained when the nip part N reaches a temperature at which fixing is possible. When the temperature of the side core 43 exceeds its Curie temperature, the magnetic permeability of the side core 43 is rapidly lowered, preventing the side core 43 from functioning as a magnetic body. The Curie temperature of the side core 43 is set to a prescribed temperature by, for example, adjusting the ratio of materials (such as in a Mn—Zn alloy). The side core 43 has, for example, a length (in the X direction) of 57 mm, a width (in the Y direction) of 12 mm, and a thickness of 3.5 mm. For example, the six side cores 43 are disposed on one flange 38*d* of the bobbin 38 in the X direction so that their side surfaces are mutually brought into contact. Another six side cores 43 are also disposed on the other flange 38*d* in the X direction so that their surfaces are mutually brought into contact. The thermal capacity of one side core 43 is calculated to be, for example, 10 J/K from its specific gravity and specific heat. As described above, the side core 43 is shaped with specific dimensions and is disposed so that the side surfaces of the side cores 43 are mutually brought into contact. As such, the thermal capacity of the side core 43 becomes comparatively high and the ability of side core 43 to track changes in the temperature of the heat-generating belt 26 is inferior compared to the end-sides of center core 42.

The standing wall 38*c* of the bobbin 38 has first standing walls extending in the X direction so as to face each other. The standing wall 38*c* also has second standing walls, in an arc shape, extending from the first standing walls, which face each other. The second standing walls form the outer edges at both ends in the X direction.

The outer edge of the standing wall 38*c* has substantially the same shape as the hollow area 37*a* formed in the loop of the wound coil 37. When the hollow area 37*a* of the coil 37 is created in the interior of the standing wall 38*c*, the coil 37 can be attached to the bobbin 38. The hollow area 37*a* of the coil 37 has, for example, a dimension of 330 mm in the X direction and a dimension of 10 mm in the Y direction (paper conveyance direction) orthogonal to the X direction. The outer edge of the standing wall 38*c* has, for example, a dimension of 329 mm in the X direction and a dimension of 9.4 mm in the direction Y (paper conveyance direction).

A rectangular space, in which end-sides of center core 42 are placed, is formed inside the standing wall 38*c*. The rectangular space is formed so as to be longer in the X direction than a paper feeding area A, allowing for the paper 9 to have the maximum size for which the fixing process is possible. The thickness of the standing wall 38*c* is designed to suppress the heat generated from the excited coil 37 from being radiated and transferred to the end-sides of center core 42. The thickness of the standing wall 38*c* (the length from the outer edge to the inner edge) is, for example, 1.5 mm. The length of the rectangular space in the Y direction is, for example, 6.4 mm.

The end-sides of center core 42 are placed in the rectangular space inside the standing wall 38*c*. As noted, the dimensions of paper 9 may be smaller than the maximum size allowable and may still be inserted into the nip part N. Thus, when the paper 9 is smaller than the maximum size, non-feeding areas C are created at both ends adjacent to the paper feeding area B.

The end-sides of center core 42 are formed in a rectangular "parallelepiped" shape by using, for example, a ferrite with high magnetic permeability such as a ferrite based on an Mn—Zn alloy. The Curie temperature at the end-sides of center core 42 is set to a temperature greater than or equal to a given temperature (100° C., for example). In some instances, the Curie temperature may be set to a temperature greater than or equal to the temperature at which fixing is possible at the nip part N, but it may be lower than the Curie temperature of the arch core 41 (see FIG. 4). When the temperature of the end-sides of center core 42 exceeds the Curie temperature, the magnetic permeability of the end-sides of center core 42 is rapidly lowered, resulting in the inability of the end-sides of center core 42 to function as a magnetic body. The Curie temperature of the end-sides of center core 42 are set to, for example, 130° C. by adjusting the ratio of materials (such as in an Mn—Zn alloy). The end-sides of center core 42 have a lower thermal capacity than the arch core 41. The end-sides of center core 42 have, for example, a length in the X direction of 18 mm, a width in the Y direction of 5 mm, and a height of 7 mm. The thermal capacity of one end-side of center core 42 is calculated to be, for example, 2.7 J/K from its specific gravity and specific heat. Since the end-sides of center core 42 have a lower thermal capacity than the arch core 41 and is placed closer to the heat-generating belt 26 than the arch core 41, the end-sides center core 42 are designed to track changes in the temperature of the heat-generating belt 26 more accurately than the arch core 41. Consider that the temperature of the heat-generating belt 26 is raised in the area corresponding to the non-feeding area C. Since the end-sides of center core 42 may track changes in the temperature of the heat-generating belt 26 more accurately, the heat-generating belt 26 does not incur any thermal damage at the Curie temperature set for the end-sides of center core 42.

In some embodiments, the Curie temperature of the end-sides of center core 42 is set to or below a cooling temperature (about 160° C.) for the coil 37. Although the heat-resistant temperature of the coil 37 is 200° C., the cooling temperature for the coil 37 is set in consideration of the heat-resistant temperature (about 180° C.) of the fusing layer of the coil 37. When the heat-resistant temperature of the fusing layer is exceeded, the prescribed shape of the coil 37 may become deformed. In some instances, the Curie temperature at the end-sides of center core 42 is set to or below the cooling temperature set for the coil 37. As noted, the temperature in the area corresponding to the non-feeding area C on the heat-generating belt 26 may become excessively high. Nonetheless, the end-sides of center core 42 have an appropriate Curie temperature and since they have the ability to lose their magnetism, the end-sides of center core 42 are prevented from being damaged from the heat-generating belt 26.

In the paper feeding area B of the fixing device 5, the magnetic flux generated from the coil 37 passes through a magnetic path that includes the inductive heat-generating layer 26*a* of the heat-generating belt 26, the side cores 43, and the arch cores 41. Thus, electromagnetic induction causes an eddy current to flow in the inductive heat-generating layer 26*a* of the heat-generating belt 26 and thereby the inductive heat-generating layer 26*a* of the heat-generating belt 26 generates heat. In the non-feeding area C, the magnetic flux generated from the coil 37 passes through a magnetic path that includes the end-sides of center core 42, the inductive heat-generating layer 26*a* of the heat-generating belt 26, the sides of center core 43, and the arch cores 41. Thus, electromagnetic induction causes an eddy current to flow in the inductive heat-generating layer 26*a* of the heat-generating belt 26 and thereby the inductive heat-generating layer 26*a* of the heat-generating belt 26 generates heat. The paper 9 held in the nip part N by the heat-generating belt 26 is heated and is pressurized by the pressurizing roller 19, so toner transcribed to the paper 9 in a powder state is melted and fixed to the paper 9.

Figure 6A:
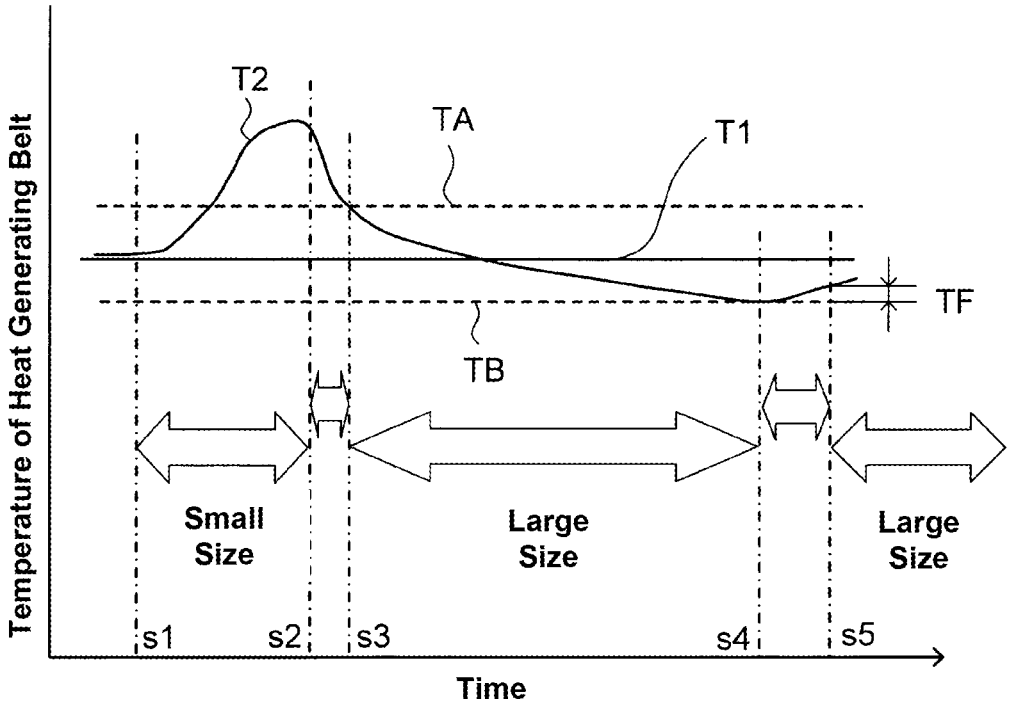
FIG. 6A is a graph illustrating changes in temperature on the surface of a heat-generating belt in this embodiment when paper sheets are fed in succession.
Figure 6B:
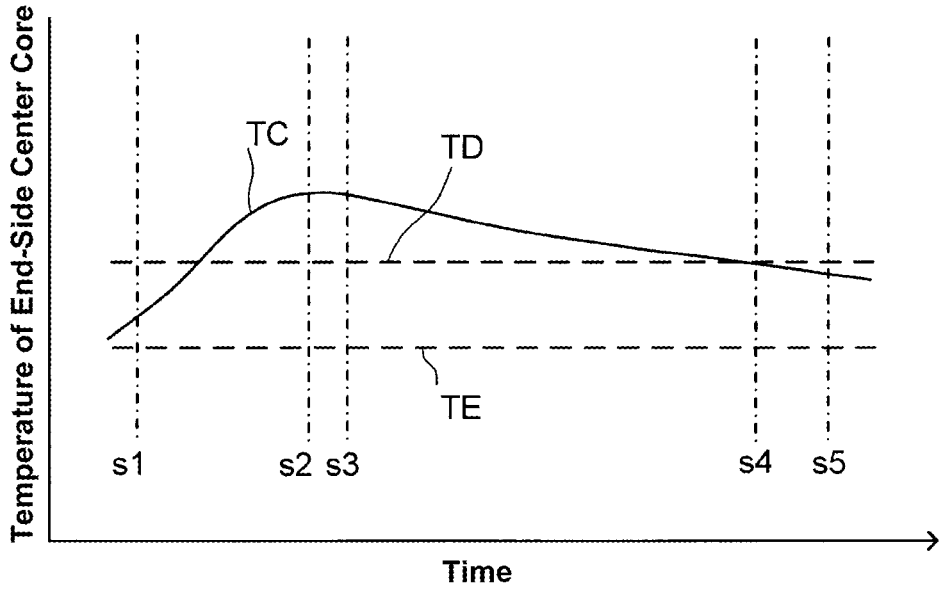
FIG. 6B is a graph illustrating changes in temperature on the surface of the end-sides of the center core in this embodiment when paper sheets are fed in succession.

A spacing between two paper sheets 9 is controlled on the basis of the temperature on the surface of the heat-generating belt 26 as illustrated in FIGS. 6A and 6B. FIG. 6A illustrates changes in the temperature on the surface of the heat-generating belt 26. FIG. 6B illustrates changes in the temperature on the end-sides of center core 42 (represented as "End-Side Center Core" on the vertical axis). The graphs in FIGS. 6A and 6B indicate time in seconds on the horizontal axis and also indicate temperature in degrees Celsius (° C.) on the vertical axis. In FIG. 6A, first surface temperature T1 is a temperature sensed by the non-contact temperature sensing element 25*a* (see FIG. 2) and second surface temperature T2 is a temperature sensed by the thermistor 25*b* (see FIG. 2). When the surface temperature of the heat-generating belt 26 is between an upper fixing-ready temperature limit TA (200° C., for example) to which fixing is possible and a lower fixing-ready temperature limit TB (165° C., for example) to which fixing is possible, an image can be obtained on an uneven gloss and other image-related problems may be suppressed. In FIG. 6B, TC is the temperature of the end-sides of center core 42, TD is the Curie temperature of the end-sides of center core 42, and TE is the temperature (100° C., for example) of the end-sides of center core 42 in a standby state.

The controller 62 (see FIG. 2) performs controlling functions according to the first surface temperature T1 input from the non-contact temperature sensing element 25*a* and the second surface temperature T2 input from the thermistor 25*b*, as described below.

At time s1, the first surface temperature T1 and second surface temperature T2 reach a prescribed fixing-ready temperature that is, for example, at least 170° C. and at most 180° C. A small-sized paper 9, which is a first recording medium, undergoes the fixing process in the nip part N for a period from s1 to s2. During the paper feeding process in this period from s1 to s2 and later periods as well, the first surface temperature T1 is controlled and set to the prescribed fixing-ready temperature (180° C., for example). Since the small-sized paper 9 is fixed, temperature on the heat-generating belt 26 is raised in the area corresponding to the non-feeding area C (see FIG. 5) in the period from s1 to s2. For example, temperature is raised to almost 230° C., which is the heat-resistant temperature of the heat-generating belt 26. Temperature TC of both ends of center core is raised from temperature TE in a standby state to Curie temperature TD and is further raised. Upon completion of the fixing process at time s2, the second surface temperature T2 rapidly drops, but temperature TC at both ends of center core gradually drops.

When the second surface temperature T2 drops to the upper fixing-ready temperature limit TA at time s3, an image with desirable characteristics is obtained. Further, a large-sized paper 9, which is a second recording medium, is inserted into the nip part N and fixing process is performed on the large-sized paper 9 regardless of temperature TC of the end-sides of center core. In a period from time s3 to s4, during which the fixing process is performed on the large-sized paper 9, the first surface temperature T1 is controlled and changed to the prescribed fixing-ready temperature and the second surface temperature T2 is between the upper fixing-ready temperature limit TA and the lower fixing-ready temperature limit TB. During the fixing process on the large-sized paper 9, an image can be obtained on an uneven gloss and other image-related problems may be suppressed. Since the fixing process on the large-sized paper 9 is started immediately after the completion of the fixing process on the small-sized paper 9, the time between s2 and s3 (to wait until the fixing process is performed on the large-sized paper 9) is shortened.

As the fixing process on the large-sized paper 9 proceeds, the second surface temperature T2 drops and temperature TC at the end-sides of center core also drops below Curie temperature TD at time s4. Since temperature TC drops below Curie temperature TD, a magnetic path is formed in an area corresponding to each non-feeding area C on the heat-generating belt 26. This magnetic path causes an area around the non-feeding area C to generate heat, raising the second surface temperature T2. The second surface temperature T2 is raised by a prescribed temperature TF (5° C., for example) from the lower fixing-ready temperature limit TB at time s5. As such, the subsequent large-sized paper 9, which is the second recording medium, is inserted into the nip area N and the fixing process is performed on the subsequent large-sized paper 9. The prescribed temperature TF is set so that even if there are variations in temperature sensing, the fixing process is reliably executed in the fixing-ready temperature range.

In some embodiments, during the second fixing process on the subsequent large-sized paper 9, an image is obtained by suppressing a fixing failure due to a low-temperature offset. Furthermore, the second fixing process on the large-sized paper 9 is started at time s5 immediately after the completion of the first fixing process on the large-sized paper 9 at time s4. Thus, the time between s4 and s5 (waiting until the second fixing process is performed on the large-sized paper 9) is shortened.

Figure 7:
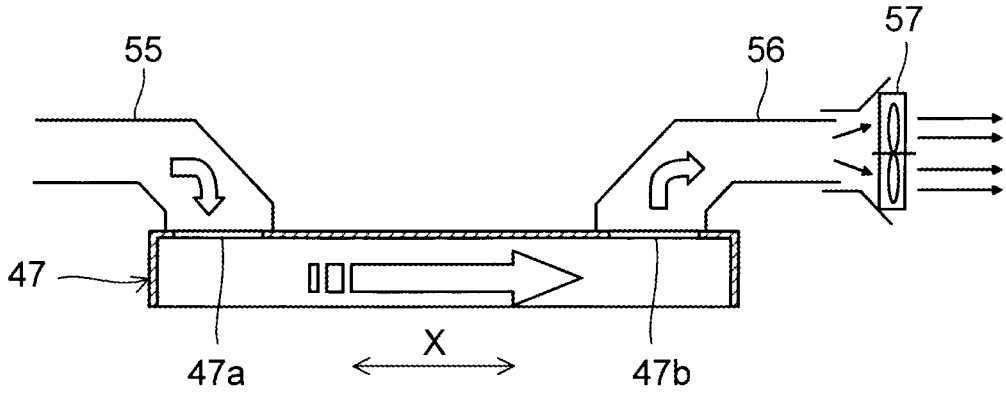
FIG. 7 is an elevated, cross-sectional view of an exhaust fan and ventilating ducts that cool the inductive heating unit in this embodiment.

FIG. 7 illustrates a cross-sectional view of a structure to exhaust heat from the inductive heating unit 30. FIG. 7 illustrates the cover 47 that is taken along the X direction. In FIG. 7, the coil 37, the magnetic core 39, and other components accommodated in the cover 47 are omitted.

When the coil 37 (see FIG. 3) is energized and excited so as to generate a magnetic flux and the coil 37 generates heat by itself, temperature in the cover 47 may increase. In this embodiment, an intake duct 55, an exhaust duct 56, which is a ventilation path, and an exhaust fan 57 are provided. Thus, it is possible to suppress the temperature of the coil 37 and prevent the temperature from being raised.

The upper surface of the cover 47 has a first upper-surface opening 47*a* at one end in the X direction and also has a second upper-surface opening 47*b* at another end. The first upper-surface opening 47*a* is formed on an intake side. The intake duct 55 is disposed so as to face the first upper-surface opening 47*a*. The second upper-surface opening 47*b* is formed on an exhaust side. The exhaust duct 56 is disposed so as to face the second upper-surface opening 47*b*. The exhaust duct 56 is attached so that an opening formed at one end of the exhaust duct 56 faces the second upper-surface opening 47*b* and an opening formed at the other end faces the exhaust fan 57. The exhaust fan 57 is attached so as to face the exhaust duct 56, blowing the air in the X direction out from exhaust duct 56.

When the exhaust fan 57 is driven and its blades rotate, air is taken in from the intake duct 55 through the first upper-surface opening 47*a* into the cover 47. An air jet formed by the exhaust fan 57 directs hot air that has been heated from the coil 37 (see FIG. 3). In some instances, the hot air is directed to the exhaust duct 56 through the second upper-surface opening 47*b* and the hot air is then blown outside of exhaust duct 56.

Figure 8:
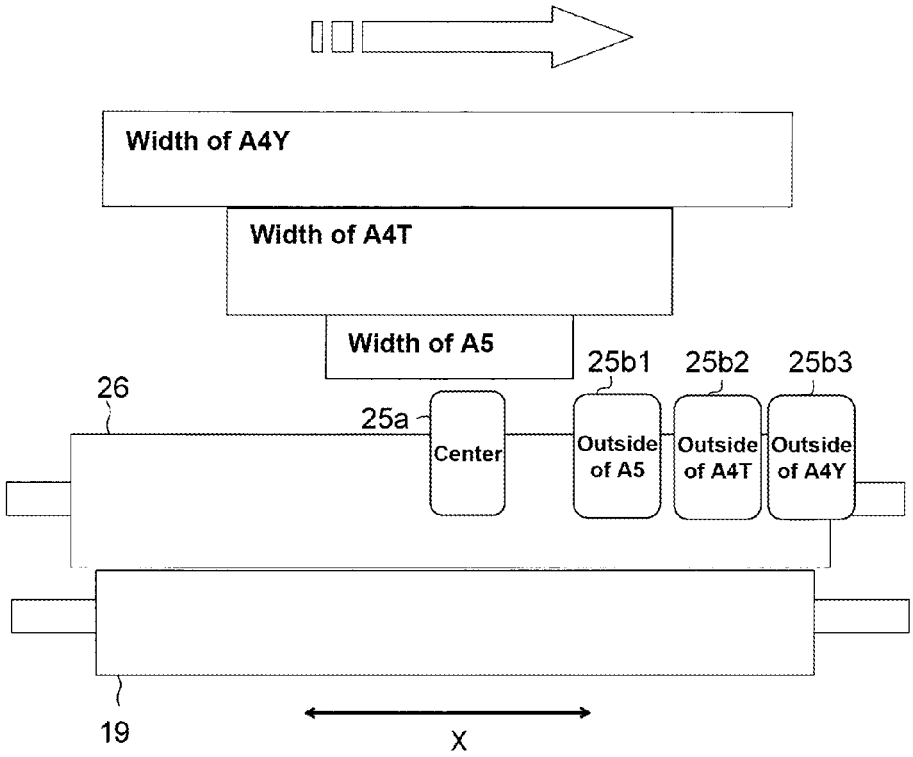
FIG. 8 is a plan view illustrating the placement of temperature sensors.

FIG. 8 is a plan view illustrating the placement of the non-contact temperature sensing element 25*a* and thermistors 25*b*1, 25*b*2, and 25*b*3. The non-contact temperature sensing element 25*a* is placed substantially at the center of the heat-generating belt 26 in the width direction. As illustrated in FIG. 8, a plurality of thermistors 25*b*1, 25*b*2, and 25*b*3 are placed according to, for example, the width of the paper 9 to be fed. For example, as illustrated in FIG. 8, a thermistor 25*b*1 is placed outside of A5-sized paper 9 in the width direction, a thermistor 25*b*2 is placed outside of A4T-sized paper 9 in the width direction, and a thermistor 25*b*3 is placed outside of A4Y-sized paper 9 in the width direction. The thermistors 25*b*1, 25*b*2, and 25*b*3 are placed on the downstream side of the heat-generating belt 26 in the X direction with respect to a direction (indicated by the arrow in FIG. 8) in which air is blown by the exhaust fan 57. Although the downstream end in the direction in which air is blown by the exhaust fan 57 is likely to become hot, the thermistors 25*b*1, 25*b*2, and 25*b*3 are placed on the downstream side in the direction that the air is blown and the temperature of the heat-generating belt 26 is controlled accordingly. This can suppress temperatures on the upstream end of the heat-generating belt 26 from being excessively high.

As described above, a fixing device is structured so that it can be determined whether the temperature of the magnetic core exceeds its Curie temperature. In some embodiments, the determination is made by measuring an overcurrent flowing in the coil. In this fixing device, a member that measures the Curie temperature of the magnetic core is provided. Furthermore, a time to wait from when the fixing process has been completed on small-sized paper until fixing process is performed on subsequent paper with a fixed size may be prolonged.

In some embodiments, considering the fixing device and the image forming apparatus equipped with the fixing device, the ends of the magnetic core can accurately track changes in the temperature of a heating member. It is also possible to shorten the waiting period from when the fixing process has been completed on small-sized paper to when the fixing process is performed on large-sized paper.

In this embodiment in the present disclosure, a fixing process is performed on a recording medium with a large width after the completion of a fixing process on a recording medium with a small width (as described in reference to FIGS. 6A and 6B). As such, the recording medium with a large width is inserted into the nip part and undergoes the fixing process. The recording medium undergoes the fixing process after temperatures at both ends of the heating member are raised above the upper fixing-ready temperature limit. The central part of the heating member is set to the fixing ready temperature and then drops to or below the upper fixing-ready temperature limit. Accordingly, after the completion of fixing process on the recording medium with a small width, the fixing process is performed on the recording medium with a large width regardless of whether the temperatures of the second core parts have reached their Curie temperature. Thus, the time between the completion of the fixing process on the recording medium with a small width and the beginning of the fixing process with a large width is shortened. Therefore, an image can be obtained while also suppressing an uneven gloss and other image-related problems.

In the above example embodiments, the fixing device 5 in which the heat-generating belt 26 is stretched by the fixing roller 18 is provided as an example and the present disclosure is not limited to this example. For instance, the structure in the example embodiments may be applied to a fixing device in which a perpetual heat-generating belt is stretched between a heat roller and a fixing roller. The heat roller may face an inductive heating unit and the fixing roller may make contact with a pressurizing roller which applies pressure against the fixing roller. Alternatively, the structure in the example embodiments may be applied to a fixing device that has an inductive heating unit that heats an endless heat-generating belt. Further, the fixing device may have a pressurizing roller in which the outer circumferential surface of the heat generating belt is brought into pressured contact with the pressurizing roller. Yet further, the fixing device may have a pressing member disposed on the inner circumferential surface of the heat-generating belt so that paper and the heat-generating belt are mutually brought into pressured contact between the pressing roller and the pressing member. In addition, the structure in the embodiment may be applied to other various types of fixing devices that have an inductive heating member. For example, the fixing device may have a pressuring roller and a heating roller which is brought into contact by the pressuring roller. Further, the heating roller may include an inductive heat-generating layer and may be positioned so as to face an inductive heating member.

Although, in the above embodiment, the arch core 41 and side core 43 have been separately disposed, the present disclosure is not limited to this structure. The arch core 41 may extend toward the side core 43 and the arch core 41 may include the function of the side core 43.

Although, in some embodiments, the arch core 41 has been attached through the arch core holder 45 to the bobbin 38, the present disclosure is not limited to this structure. The arch core 41 may be attached directly to the bobbin 38.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent apparatuses and methods within the scope of the disclosure, in addition to those enumerated herein, will be apparent to those skilled in the art from the foregoing descriptions. Such modifications and variations are intended to fall within the scope of the appended claims.

What is claimed is:

1. A fixing device comprising:

a heating member;

a pressurizing member that makes pressured contact with the heating member;

a coil wound in a loop shape in a width direction of the heating member, wherein the coil is configured to generate a magnetic flux that inductively heats the heating member; and a magnetic core adjacent to the coil, wherein the magnetic core is configured to apply the magnetic flux to an inductive heat-generating layer of the heating member; wherein the magnetic core includes:

a plurality of first core parts that are positioned to enclose the coil in a direction orthogonal to a paper conveyance direction, wherein a recording medium is conveyed in the paper conveyance direction, a plurality of second core parts that are placed in hollow areas formed by loops of the coil at both ends in the direction orthogonal to the paper conveyance direction, wherein the plurality of second core parts have a lower Curie temperature and a lower thermal capacity than the plurality of first core parts, and wherein after a first fixing process is performed on a first recording medium and a surface temperature in non-feeding areas is raised above an upper fixing-ready temperature limit, a second fixing process is performed on a second recording medium having a larger width than the first recording medium, and wherein the first recording medium has a smaller width than a maximum width for the first fixing process and the second fixing process, and wherein after the surface temperature in non-feeding areas drops to or below the upper fixing-ready temperature limit, the second recording medium is inserted into a nip part formed by the heating member and the pressurizing member.

2. The fixing device according to claim 1, further comprising:

a first temperature sensor that senses a first surface temperature at a center of the heating member in the width direction;

a second temperature sensor that senses a second surface temperature of the non-feeding areas that are formed at both ends of the heating member in the width direction by the first recording medium; and a controller that controls a high-frequency current to be supplied to the coil so that the first surface temperature reaches a prescribed fixing ready temperature and also controls timings through which a plurality of recording media are fed in succession to the nip part, according to the first surface temperature sensed by the first temperature sensor and the second surface temperature sensed by the second temperature sensor; wherein when the second fixing process is performed on the second recording medium and the second surface temperature is raised above an upper fixing-ready temperature limit, the controller controls the fixing device such that the second recording medium is inserted into the nip part after the second surface temperature drops to or below the upper fixing-ready temperature limit.

3. The fixing device according to claim 2, wherein when the second fixing process is performed on a plurality of second recording media in succession, the controller controls the fixing device to insert a subsequent second recording medium into the nip part after the second surface temperature is raised by a prescribed temperature from a lower fixing-ready temperature limit.

4. The fixing device according to claim 2, wherein the second temperature sensor includes a plurality of second temperature sensing elements; and wherein the plurality of second temperature sensing elements are disposed so as to sense temperatures corresponding to different widths of recording mediums to be fed.

5. The fixing device according to claim 1, wherein a Curie temperature of the plurality of second core parts is less than or equal to a cooling temperature set for the coil.

6. The fixing device according to claim 1, further comprising a bobbin to which the coil is secured, wherein:

the bobbin has a standing wall erected from a surface of the bobbin;

the standing wall has a pair of first standing walls configured to face each other and extend in the width direction of the heating member, wherein the standing wall further has a pair of second standing walls formed at both ends of the pair of first standing walls;

an outer edge of the standing wall is defined by outer surfaces of the pair of first standing walls in the paper conveyance direction and outer surfaces of the pair of second standing walls in the width direction;

an inner edge of the standing wall is defined by inner surfaces of the pair of first standing walls in the paper conveyance direction and inner surfaces of the pair of second standing walls in the width direction;

inner edges of the loops of the coil are placed outside the outer edge of the standing wall so that the coil is secured to the bobbin; and the plurality of second core parts are placed at both ends of the inner edge of the standing wall in the width direction.

7. The fixing device according to claim 1, further comprising a cooling means that supplies cooling air along a width direction of the coil to cool the coil.

8. The fixing device according to claim 7, further comprising a cover positioned so as to cover the first core part, wherein the cooling means includes:

an intake duct placed at one end of the cover in the width direction that communicates with a first opening formed at the one end of the cover in the width direction, an exhaust duct, placed at another end of the cover in the width direction, that communicates with a second opening formed at the another end of the cover in the width direction, and an exhaust fan disposed so as to face a third opening of the exhaust duct, the third opening being opposite to an opening of the exhaust duct formed on the same side as the second opening.

9. The fixing device according to claim 8, wherein the second temperature sensor is disposed at a downstream end in the width direction of the heating member with respect to a direction in which air is blown by the cooling means.

10. The fixing device according to claim 8, wherein a first thermistor is positioned outside the width direction of a first size of paper, a second thermistor is positioned outside the width direction of a second size of paper, and a third thermistor is positioned outside the width direction of a third size of paper.

11. An image forming apparatus comprising:

an image forming unit; and a fixing device including:

a heating member;

a pressurizing member that makes pressured contact with the heating member;

a coil wound in a loop shape in a width direction of the heating member, wherein the coil is configured to generate a magnetic flux that inductively heats the heating member; and a magnetic core adjacent to the coil, wherein the magnetic core is configured to apply the magnetic flux to an inductive heat-generating layer of the heating member; wherein the magnetic core includes:

a plurality of first core parts that are positioned to enclose the coil in a direction orthogonal to a paper conveyance direction, wherein a recording medium is conveyed in the paper conveyance direction, a plurality of second core parts that are placed in hollow areas formed by loops of the coil at both ends in the direction orthogonal to the paper conveyance direction, wherein the plurality of second core parts have a lower Curie temperature and a lower thermal capacity than the plurality of first core parts, and wherein after a first fixing process is performed on a first recording medium and a surface temperature in non-feeding areas is raised above an upper fixing-ready temperature limit, a second fixing process is performed on a second recording medium having a larger width than the first recording medium, and wherein the first recording medium has a smaller width than a maximum width for the first fixing process and the second fixing process, and wherein after the surface temperature in non-feeding areas drops to or below the upper fixing-ready temperature limit, the second recording medium is inserted into a nip part formed by the heating member and the pressurizing member.

12. The image forming apparatus according to claim 11, wherein the fixing device further includes:

a first temperature sensor that senses a first surface temperature at a center of the heating member in the width direction;

a second temperature sensor that senses a second surface temperature of the non-feeding areas that are formed at both ends of the heating member in the width direction by the first recording medium; and a controller that controls a high-frequency current to be supplied to the coil so that the first surface temperature reaches a prescribed fixing ready temperature and also controls timings through which a plurality of recording media are fed in succession to the nip part, according to the first surface temperature sensed by the first temperature sensor and the second surface temperature sensed by the second temperature sensor; and when the second fixing process is performed on the second recording medium and the second surface temperature is raised above an upper fixing-ready temperature limit, the controller controls the fixing device such that the second recording medium is inserted into the nip part after the second surface temperature drops to or below the upper fixing-ready temperature limit.

13. The image forming apparatus according to claim 12, wherein when the second fixing process is performed on a plurality of second recording media in succession, the controller controls the fixing device to insert a subsequent second recording medium into the nip part after the second surface temperature is raised by a prescribed temperature from a lower fixing-ready temperature limit.

14. The image forming apparatus according to claim 12, wherein the second temperature sensor includes a plurality of second temperature sensing elements; and wherein the plurality of second temperature sensing elements are disposed so as to correspond to different widths of recording mediums to be fed.

15. The image forming apparatus according to claim 11, wherein a Curie temperature of the plurality of second core parts is less than or equal to a cooling temperature set for the coil.

16. The image forming apparatus according to claim 11, wherein the fixing device further includes a bobbin to which the coil is secured; and wherein:

the bobbin has a standing wall erected from a surface of the bobbin;

the standing wall has a pair of first standing configured to face each other and extend in the width direction of the heating member, wherein the standing wall further has a pair of second standing walls formed at both ends of the pair of first standing walls;

an outer edge of the standing wall is defined by outer surfaces of the pair of first standing walls in the paper conveyance direction and outer surfaces of the pair of second standing walls in the width direction;

an inner edge of the standing wall is defined by inner surfaces of the pair of first standing walls in the paper conveyance direction and inner surfaces of the pair of second standing walls in the width direction;

inner edges of the loops of the coil are placed outside the outer edge of the standing wall, so that the coil is secured to the bobbin; and the plurality of second core parts are placed at both ends of the inner edge of the standing wall in the width direction.

17. The image forming apparatus according to claim 11, wherein the fixing device further includes a cooling means that supplies cooling air along a width direction of the coil to cool the coil.

18. The image forming apparatus according to claim 17, wherein the fixing device further includes a cover positioned so as to cover the first core part; and wherein the cooling means includes:

an intake duct, placed at one end of the cover in the width direction, that communicates with a first opening formed at the one end of the cover in the width direction, an exhaust duct, placed at another end of the cover in the width direction, that communicates with a second opening formed at the another end of the cover in the width direction, and an exhaust fan disposed so as to face a third opening of the exhaust duct, the third opening being opposite to an opening of the exhaust duct formed on the same side as the second opening.

19. The image forming apparatus according to claim 18, wherein the second temperature sensor is disposed at a downstream end in the width direction of the heating member with respect to a direction in which air is blown by the cooling means.

20. The image forming apparatus according to claim 18, wherein the fixing device further includes a first thermistor positioned outside the width direction of a first size of paper, a second thermistor positioned outside the width direction of a second size of paper, and a third thermistor positioned outside the width direction of a third size of paper.

* * * * *